United States Patent [19]

Meade

[11] 4,362,289

[45] Dec. 7, 1982

[54] SUPPORT BASE FOR A MACHINE OR THE LIKE

[75] Inventor: Albert J. Meade, St. Louis County, Mo.

[73] Assignee: Ancel Products, Inc., St. Louis, Mo.

[21] Appl. No.: 29,273

[22] Filed: Apr. 12, 1979

[51] Int. Cl.[3] ..... B22D 29/00

[52] U.S. Cl. ..... 248/656; 248/670; 248/661; 51/164.1

[58] Field of Search ..... 248/656, 661, 670; 308/25; 51/164.1; 164/404

[56] References Cited

U.S. PATENT DOCUMENTS

| | | | |
|---|---|---|---|
| 802,394 | 10/1905 | Hill | 308/25 |
| 1,813,045 | 7/1931 | Franks | 248/656 |
| 1,987,726 | 1/1935 | Wilkerson et al. | 248/656 |
| 2,002,796 | 5/1935 | Purkett | 51/164.1 X |
| 2,044,536 | 6/1936 | Maier | 308/25 X |
| 2,511,613 | 6/1950 | Woolslayer et al. | 248/670 |
| 3,248,077 | 4/1966 | Charles | 248/670 |
| 3,487,840 | 1/1970 | Stenzel et al. | 51/164.1 X |
| 3,998,262 | 12/1976 | Didion | 51/164.1 X |

FOREIGN PATENT DOCUMENTS

| | | | |
|---|---|---|---|
| 20248 | 2/1966 | Sweden | 248/670 |

*Primary Examiner*—William H. Schultz
*Attorney, Agent, or Firm*—Lionel L. Lucchesi

[57] ABSTRACT

A support base for a machine or the like in which reference points on the support base may be readily and selectively adjusted so as to support the machine in a desired manner and so as to accommodate distortions or other forms of misalignment which may be present in the support base as a result of its manufacture.

4 Claims, 9 Drawing Figures

SUPPORT BASE FOR A MACHINE OR THE LIKE

BACKGROUND OF THE INVENTION

This invention relates to a support base or a frame for a large machine or other object, and more particularly to a support base for a machine such as a so-called rotary sand/casting separator. Although described with particular reference to that application, those skilled in the art will recognize the wide applicability of this invention.

In providing a suitable support base for a rotary sand-/casting separator or the like, it is usually necessary that the support uniformly and precisely support the machine in predetermined position and alignment so as to ensure that the machine operates in its intended manner. In particular, a rotary sand/casting separator includes an elongate horizontal cylinder which is rotated about its longitudinal centerline by a drive motor. The cylinder is hollow and castings along with their molding sand are loaded into one end of the cylinder by means of a conveyor belt or the like. As the cylinder rotates, the castings and sand tumble within the cylinder thus loosening the sand from the castings. A multiplicity of holes are provided in the inner shell of the cylinder and the sand falls through these holes for discharge. The castings are fed forwardly through the cylinder out the opposite end of the cylinder as the latter is rotated. These cylinders may, for example, be quite long (e.g., 288 inches or 7.25 m.) in length and weigh several tons. The cylinder is supported on two or more sets of rotary carrier wheel which engage the lower part of the cylinder at spaced intervals along its length.

Heretofore, the support bases for these rotary sand-/casting separators were made as a one-piece weldment. However, the weldment oftentimes became distorted during fabrication and this distortion resulted in a uneven or improper support and alignment for the separator cylinder such when the latter was supported on its carrier wheels that upon operation, the cylinder would tend to become dislocated from its carrier wheel supports or to bind while rotating. This in turn caused excessive loads to be applied to the carrier wheels and to the cylinder thrust bearings. Premature thrust bearing and carrier wheel failures had, on occasion, been observed.

In order to eliminate the distortion from the base it was necessary to straighten the weldment in a large press or to stress relieve the weldment after welding. However, both of these operations are considered to be too costly and time consuming to be a practical solution.

Reference may be made to U.S. Pat. No. 3,998,262 which discloses a rotary casting/sand separator in the same general field as discussed above.

SUMMARY OF THE INVENTION

Among the several objects and features of this invention may be noted the provision of a support base or a frame for a machine, such as a rotary casting/sand separator or the like, which is made as a weldment having a plurality of machine attachment or support points adjustably movable relative to the base so as to properly support the machine in a desired position irrespective of a limited amount of distortion that may be present in the support base, subsequent to its manufacture;

The provision of such a support base which is economical to fabricate;

The provision off such a support base which can be readily fabricated using standard tooling and fabrication processes and techniques;

The provision of such a support base which allows each machine support point to be adjusted in at least two directions;

The provision of such a support base in which any selected machine attachment or support point (e.g., the location of a carrier wheel) may be adjusted substantially independently of the other support points;

The provision of such a support base on which a machine or other object may be readily installed thereon and adjusted so as to be in its desired operational position and alignment; and The provision of such a support base which is economical to manufacture, which rigidly and steadily supports the machine mounted thereon, which does not induce unwanted deflections and stresses in the machine, which results in a long service life for the machine supported thereon, and which is safe to use.

Briefly, a support base of this invention for a machine or the like comprises a frame having first and second axis extending therealong and having at least two supports spaced at intervals on said frame, each of said supports having at least one reference point thereon. The support base includes means for adjustably securing the supports to the frame with the above mentioned reference point of each of the supports located in a predetermined position. The frame and the supports interfit with one another. The securing means comprises a first set of one or more fasteners extending in a direction parallel to one of the above-mentioned axes for interconnecting the frame and the support and a second set of one or more fasteners extending in the direction of the other of the above-mentioned axes and interconnecting the frame and the support. The first and second sets of fasteners each are independently adjustable so as to selectively and adjustably move the support relative to the frame along the above noted first and second axes and are operable so as to lock the support to the frame in a desired adjusted position with the reference points in their desired positions.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
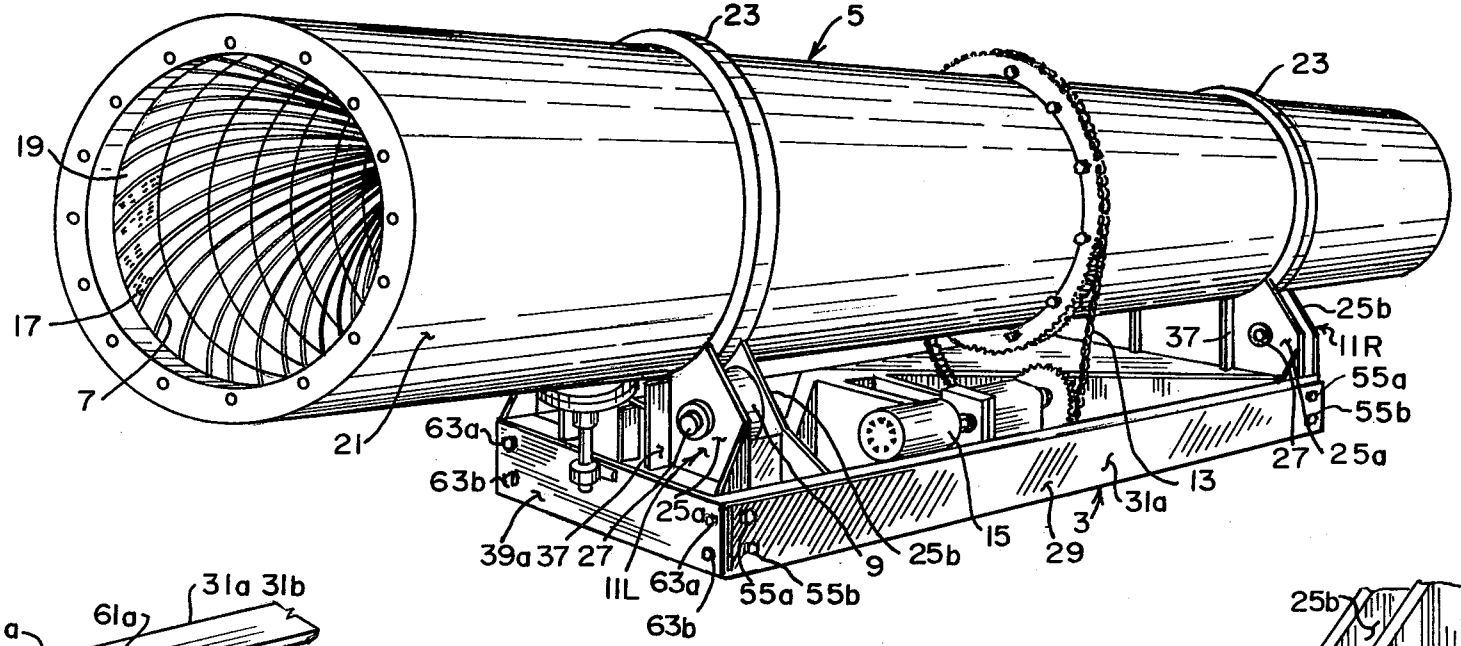
FIG. 1 is a perspective view of a machine, such as a conventional casting/sand separator, supported on a support base of this invention.
Figure 9:
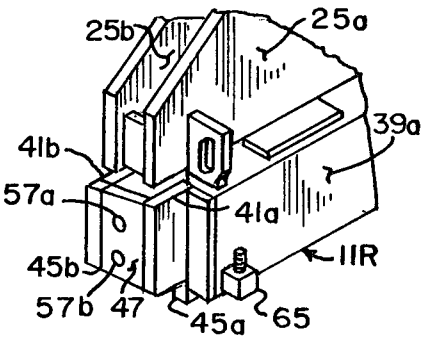
FIG. 9 is a perspective view of the portion of a machine support which is adapted to be socketed in (i.e., to interfit with) the socket shown in FIG. 8.

Referring now the drawings and more specifically to FIG. 1, a machine, such as a rotary casting/sand separator 1, is shown to be rotatably mounted on a support base of this invention, as generally indicated at 3. As shown, the sand/casting separator comprises an elongate tubular body or cylinder 5 disposed in horizontal position and adapted to be rotated about its central longitudinal axis. One end of body 5 (referred to as its inlet end) is adapted to be positioned adjacent the terminal end of a conveyor (not shown) for the delivery of castings together with the molding sand used to cast the castings into the inlet end of the body. As indicated at 7, spiral rods are secured to the inside of body 5 and protrude inwardly so that upon rotation of the body, the castings together with the sand delivered into the inlet end of the body is conveyed lengthwise through the body and the sand and the castings are caused to tumble within the body. Body 5 is journalled by carrier wheels 9 (four of which are shown) supported in rigid supports, as generally indicated at 11R, 11L, at the end of base 3 and forming a part of the base. Body 5 is rotatably driven by a chain and sprocket arrangement 13 driven via an electric motor 15 mounted on base 3. As body 5 is rotated, the castings and the sand tumble therewithin thereby knocking the sand loose from the casting without damage to the castings. The sand falls through holes 17 in the inner wall 19 of the body and enters an annular space between the inner wall 19 and the outer wall 21 of the body and the sand is removed from this annular space by means of an appropriate outlet (not shown) located at a desired position along the length of the body.

As shown, body 5 has rings 23 therearound which engage carrier wheels 9 and which fit inbetween spaced side walls 25*a*, 25*b* of each support 11R or 11L so as to prevent axial shifting of body 5 relative to base 3 as the body rotates and so as to keep rings 23 in rolling engagement with carrier wheels 9. The carrier wheels are journalled on axles 27 which are precision mounted between side walls 25*a* and 25*b* of the supports such that the longitudinal axis of the axles are parallel to one another and are accurately positioned so that the carrier wheels maintain the body in a desired position and alignment. Of course, appropriate guards and shields (not shown) cover chain and sprocket arrangement 13 and carrier wheels 9.

In accordance with this invention support base 3 is shown to be a rigid structure adapted to support body 5 for rotation about its longitudinal centerline. It is particularly important to the successful operation of a rotary casting/sand separator that body 5 be accurately and precisely supported on carrier wheels 9 so that the body rotates freely on the carrier wheels and so that it does not tend to move longitudinally which would tend to cause binding of the body. In order to properly support the body, it is necessary that the centerlines of the axles 27 (referred to as reference points) be accurately positioned relative to one another. The support base of this invention permits the ready adjustment of supports 11R, 11L relative to frame 29 so as to position and align the position of axles 27 carried by each of the supports in desired positions independently of one another.

In particular, frame 29 is a rigid structure (preferably a weldment) consisting of longitudinal side members 31*a*, 31*b* and transverse interior cross members 33*a*–33*d* rigidly secured (e.g., welded) between the side members. Additionally, oblique cross members 35*a*, 35*b* are secured in position between the side members. The side members are shown to be channel-shaped members having their webs arranged vertically with their flanges facing inwardly toward one another. The above-described cross members are also channel members essentially the same size as side members 31*a*, 31*b*. The ends of the cross members are shaped (i.e., the flanges are selectively cut away) so that the web of the cross member abuts the web and flanges of the side members thereby to permit the cross members to be butt welded to the side members.

Figure 7:
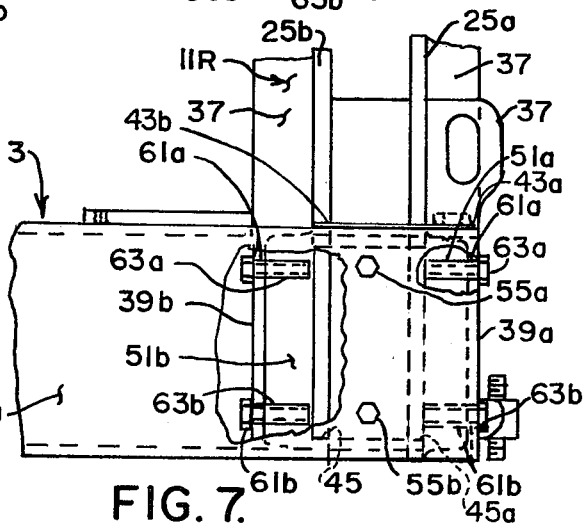
FIG. 7 is a front elevational view of FIG. 6 with parts broken away for clarity.

As previously mentioned, supports 11R, 11L are essentially identical and each comprises of a pair of spaced parallel side plates 25*a*, 25*b*. These side plates are appropriately reinforced by gussets 37 welded to the outside thereof. At the bottom of the side plates, a pair of spaced end beams 39*a*, 39*b* is provided. As shown, these end beams are a pair of channel shaped members arranged with their webs extending vertically and with their webs facing one another. Side plates 25*a*, 25*b* extend down to the bottom flange of each of the end members with the end members being welded on the outside of the side plates and with gussets 37 and plates 41 maintaining the desired spacing between the side plates. As shown in FIG. 7, the ends of side plates 25*a*, 25*b* extend out beyond the ends of the end beams and notches 43*a*, 43*b* are provided in the side plates for reception of the upper flanges of side beams 31*a*, 31*b*. The side plates are also notched, as indicated at 45*a*, 45*b*, to receive the lower flanges of the side beams. An abutment or end plate 47 is welded between the ends of the side plates intermediate notches 43 and 45. The ends of the side plates and the abutment plate of each support 11L, 11R are thus so sized as to snugly fit (i.e., to interfit) between the flanges of the side beams.

Figure 8:
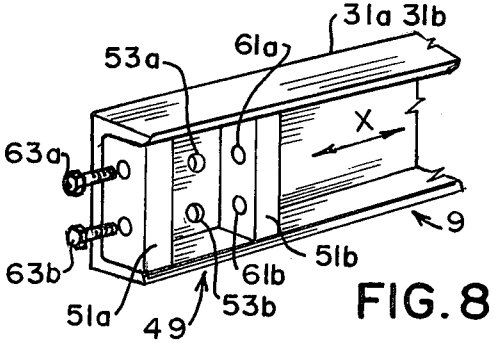
FIG. 8 is s perspective inside view one end of a longitudinal side member of the support base illustrating a socket for receiving a portion of a support for the machine.
Figure 2:
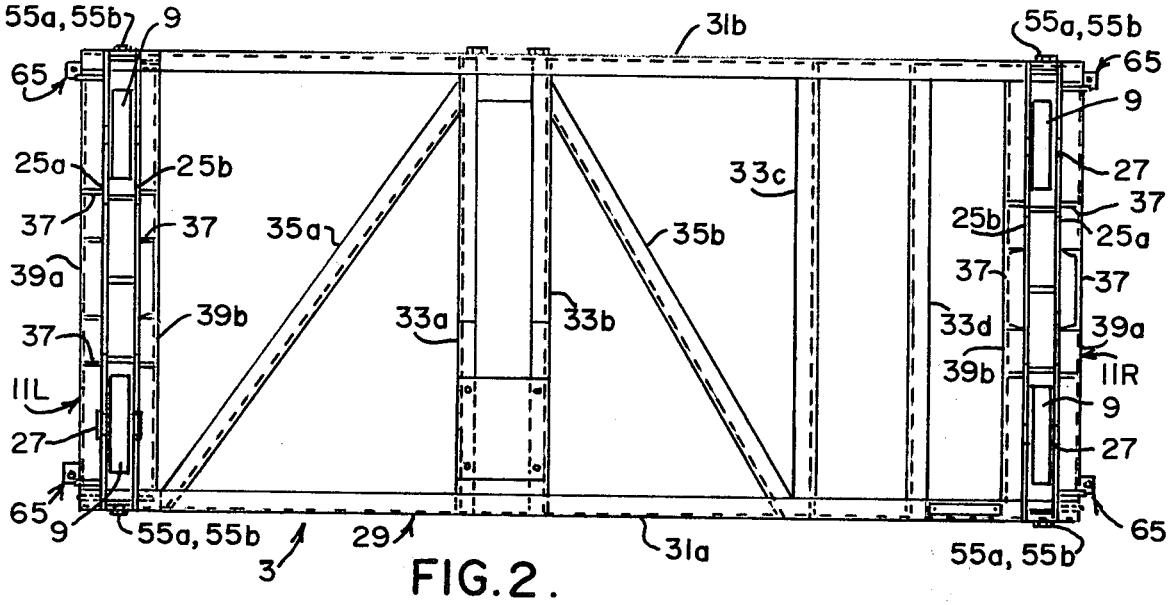
FIG. 2 is a top plan view of the support base of this invention.
Figure 3:
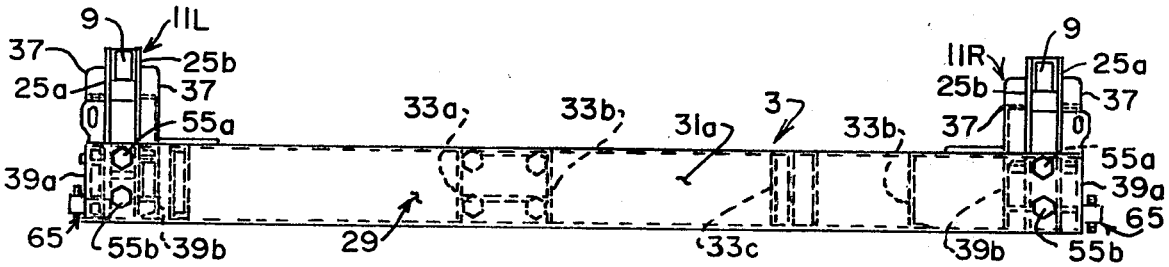
FIG. 3 is a front elevational view of the support base.
Figure 4:
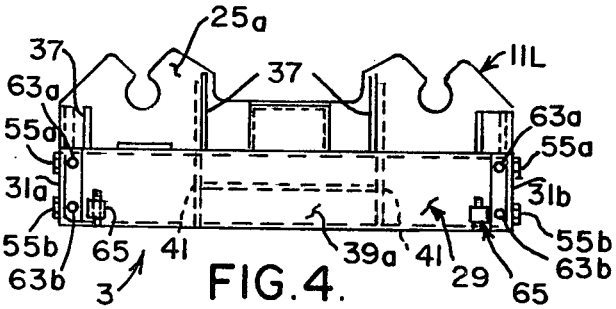
FIG. 4 is a left end elevational view of the support base.
Figure 5:
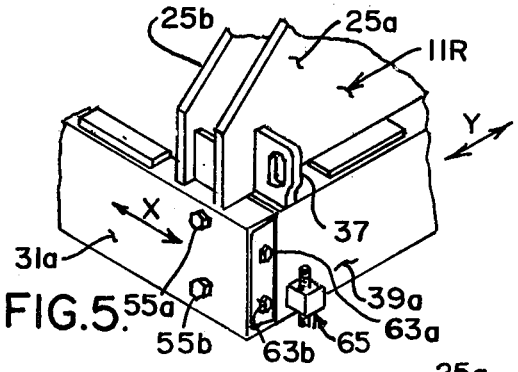
FIG. 5 is an enlarged perspective view of the left front corner of the support base as it is viewed in FIG. 3.
Figure 6:
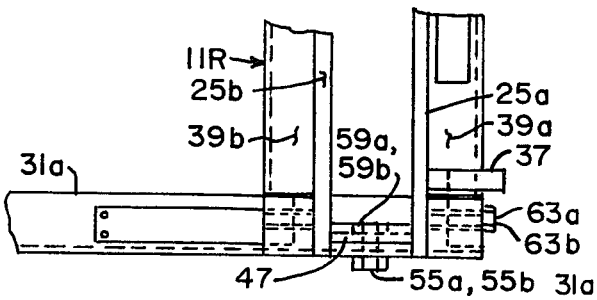
FIG. 6 is a somewhat enlarged top plan elevational view of FIG. 5.

As best shown in FIG. 8, each end of each of the side members 31*a*, 31*b* has a socket, as generally indicated at 49, for reception of the outer ends of a pair of side plates 25*a*, 25*b* of a respective support 11L or 11R. Socket 49 is comprised of a pair of rigid, spaced gussets 51*a*, 51*b* welded to the flanges and web of the side member and spaced apart a distance so as to receive the ends of the side plates 25*a*, 25*b* and to permit limited movement of the support 11L, 11R along a first direction (i.e., lengthwise of the side members or frame 29 as indicated in FIG. 5 along the axis of the frame) over a limited range. As shown, the web of side members 31*a*, 31*b* have pairs of vertically spaced threaded holes 53*a*, 53*b* between their respective gussets members 51*a*, 51*b* (see FIG. 8) adapted to receive respective threaded fasteners (e.g., bolts) 55*a*, 55*b* (see FIGS. 2–7). The ends of these bolts extend through mating unthreaded holes 57*a*, 57*b* in end plate 47 on the adjacent support 11L or 11R. Nuts 59*a*, 59*b* are threaded onto the ends of respective bolts 55*a*, 55*b* on the back side of end plate 47. By selectively tightening or loosening bolts 55*a*, 55*b* at both ends of a respective support 11R or 11L, the entire support may be selectively shifted along a second axis (as indicated by the Y axis in FIG. 5) to draw the support into or out of socket 49. Gussets 51*a*, 51*b* each have a pair of threaded holes 61*a*, 61*b* therein for threadably receiving fasteners (e.g., set screws or bolts) 63*a*, 63*b*. These fasteners extend into socket 49 along a line parallel to the X axis (see FIG. 5) and engage (i.e., bear against) the outer faces of the portions of side plates 25*a*, 25*b* which extend into the socket. The ends of the bolts bear against the side plates of the support and by appropriately tightening or loosening bolts 63*a*, 63*b*, supports 11R, 11L may be selectively and adjustably moved parallel to the X axis. Thus, bolts 55*a*, 55*b* and 63*a*, 63*b* constitute means for adjustably securing supports 11R and 11L to frame 29 with the axles 27 of rollers 9 (referred to as reference points) located in desired adjusted positions. Also, with the supports in their desired adjusted positions, with nuts 59*a*, 59*b* (see FIG. 6) tightened, and with bolt 63*a*, 63*b* snugly engaging side plates 25*a*, 25*b* of their respective supports 11R, 11L, the supports are securedly fixed (locked) relative to frame 29 so as to securely support body 5. By suitably adjusting the above-noted bolts, the position of each of the axles 27 may be independently varied within a limited range thus permitting supports 11R, 11L to accommodate limited amounts of distortion as may be present in frame 29 due to fabrication (i.e., welding) without the necessity of having to stress relieve or to mechanically straighten the frame.

As indicated at 65, four screw jacks are provided at the corners of frame 29. The screw jacks engage the floor and allow support base 3 to be accurately leveled and allow independent adjustments in the height of each support 11 to be made. Thus, the supports may not only be adjusted in horizontal direction along the X and Y axes, but it may also be adjusted in vertical direction.

In view of the above, it will be seen that the several objects of this invention are achieved and that other advantageous results are attained.

As various changes could be made in the above constructions and methods without departing from the scope of the invention, it is intended that all matter contained in the above description or shown in the accompanying drawings shall be interpreted as illustrative and not in a limiting sense.

I claim:

1. A support for a machine or the like comprising a frame having first and second axes thereon and at least two supports at spaced intervals on said frame, each of said supports having at least one reference point thereon, said support base further having means for adjustably securing said supports to said frame with said reference point of each of said supports being in a desired position, said frame and said supports interfitting with one another, said securing means comprising a first set of one or more fasteners extending in a direction parallel to said first axis and interconnecting said frame and said support and a second set of one or more fasteners extending in the direction of said second axis and interconnecting said frame and said support, said first and second sets of fasteners each being independently adjustable so as to selectively move said support relative to said frame along said first and second axes and being securingly operable so as to lock said support to said frame in its desired adjusted position with said reference points in their desired positions, said frame being a weldment having a longitudinal side member at each side thereof, said longitudinal side members being parallel to said first axis of said frame, said supports being generally perpendicular to said side members and being generally parallel to said second axis, each of said longitudinal side members having a socket therein for receiving a portion of each of said supports, said socket at least partially receiving a portion of its respective support, said first set of fasteners extending through a portion of said socket adjacent the sides of the support in a direction generally parallel to said first axis and being engageable with the sides of the support, said second set of fasteners extending through said longitudinal side member in a direction generally parallel to said second axis and being engageable with said support.

2. A support base as set forth in claim 1 wherein said first set of fasteners are threadably engageable with said socket and abuttingly engageable with said support.

3. A support base comprising a frame having first and second axes thereon and at least two supports at spaced intervals on said frame, each of said supports having at least one reference point thereon, said support base further having means for adjustably securing said supports to said frame with said reference point of each of said supports being in a desired position, said frame and said supports interfitting with one another, said securing means comprising a first set of one or more fasteners extending in a direction parallel to said first axis and interconnecting said frame and said support and a second set of one or more fasteners extending in the direction of said second axis and interconnecting said frame and said support, said first and second sets of fasteners each being independently adjustable so as to selectively move said support relative to said frame along at least one of said first and second axes and being securingly operable so as to lock said support to said frame in its desired adjusted position with said reference points in their desired positions, said frame being a weldment having a longitudinal side member at each side thereof, said longitudinal side members being parallel to said first axis of said frame, said supports being generally perpendicular to said side members and being generally parallel to said second axis, each of said longitudinal side members having a socket therein for receiving a portion of each of said supports, said socket at least partially receiving a portion of its respective support, said first set of fasteners extending through a portion of said socket adjacent the sides of the support in a direction generally parallel to said first axis and being engageable with the sides of the support, said second set of fasteners extending through said longitudinal side member in a direction generally parallel to said second axis and being engageable with said support.

4. A support base as set forth in claim 3 wherein said first set of fasteners are threadably engageable with said socket and abuttingly engageable with said support.

* * * * *